US011056044B2

(12) United States Patent
Huang et al.

(10) Patent No.: US 11,056,044 B2
(45) Date of Patent: Jul. 6, 2021

(54) METHOD OF COMPENSATING PIXEL DATA AND RELATED TIMING CONTROLLER

(71) Applicant: NOVATEK Microelectronics Corp., Hsin-Chu (TW)

(72) Inventors: Hsien-Po Huang, Hsinchu (TW); Yen-Tao Liao, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 16/258,695

(22) Filed: Jan. 28, 2019

(65) Prior Publication Data

US 2020/0243000 A1 Jul. 30, 2020

(51) Int. Cl.
*G09G 3/20* (2006.01)

(52) U.S. Cl.
CPC ... *G09G 3/2096* (2013.01); *G09G 2310/0202* (2013.01); *G09G 2310/0275* (2013.01); *G09G 2310/08* (2013.01); *G09G 2320/0209* (2013.01); *G09G 2320/0233* (2013.01)

(58) Field of Classification Search
CPC ..... G09G 3/2096; G09G 2310/0202; G09G 2310/08; G09G 2320/0209; G09G 2320/0233
See application file for complete search history.

(56) References Cited

U.S. PATENT DOCUMENTS

2017/0365202 A1* 12/2017 Lin ..... G09G 3/3233
2019/0114975 A1* 4/2019 Chen ..... G09G 3/3607
2019/0237001 A1* 8/2019 Lin ..... G09G 3/3208

* cited by examiner

*Primary Examiner* — Kenneth B Lee, Jr.
(74) *Attorney, Agent, or Firm* — Winston Hsu

(57) ABSTRACT

A method of compensating pixel data for a display panel includes the steps of: receiving a first pixel data and a second pixel data respectively corresponding to two adjacent data lines of the display panel; generating a compensation pixel data by searching a lookup table based on the first pixel data and the second pixel data; and transmitting the compensation pixel data to one of the two adjacent data lines to be displayed on the display panel.

14 Claims, 7 Drawing Sheets

METHOD OF COMPENSATING PIXEL DATA AND RELATED TIMING CONTROLLER

BACKGROUND OF THE INVENTION

1. Field of the Invention

The present invention relates to a method of compensating pixel data and a related timing controller, and more particularly, to a method of compensating pixel data and a related timing controller capable of compensating errors of pixel data caused by crosstalk.

2. Description of the Prior Art

With the trends of higher resolution of the display device, more pixel cells (or subpixel cells) are required to be included in a display panel with a limited size; hence, the area of each pixel cell may be reduced. This results in a reduced aperture ratio since the smaller pixel cells are implemented while the transistor size (e.g., the size of thin-film transistors (TFT)) remains the same.

Several layout techniques have been developed in order to increase the aperture ratio. For example, please refer to FIG. 1, which is a schematic diagram of a display panel 10. The display panel 10 includes a subpixel array, which includes a plurality of subpixel cells, where only 4 subpixel cells are illustrated for simplicity. Each subpixel cell receives gate control signals via a gate line, and correspondingly receives pixel data via a data line. In order to increase the aperture ratio, the lines may be deployed in a roundabout way to avoid covering the light path. For example, the data lines may be turned or wound instead of a straight line, such as the deployment shown in FIG. 2.

With the deployment shown in FIG. 2, the data lines are turned such that each data line becomes much closer to the subpixel cells in the adjacent column; hence, the crosstalk between two adjacent columns may become more severe, which influences the correctness of brightness shown in the subpixel cell. For example, in the display panel 10, two pixel data D1 and D2 are transmitted to two adjacent subpixel cells via two adjacent data lines, respectively. Since the left-side data line is close to the right-side subpixel cell, the pixel data D2 in the right-side subpixel cell is influenced by the pixel data D1 in the left-side data line due to the parasitic capacitance C_par between the subpixel cell and the data line, which is the so-called crosstalk. For example, if the value of the pixel data D1 is lower than the value of the pixel data D2, where the pixel data D1 corresponds to lower brightness compared to the pixel data D2, the pixel value in the right-side subpixel cell may be pulled low by the pixel data D1 in the left-side data line, resulting in lower brightness (which is an undesired wrong brightness) shown in the right-side subpixel cell.

Thus, there is a need to provide a compensation method for preventing or mitigating the crosstalk problem, so as to generate correct brightness in the subpixel cells.

SUMMARY OF THE INVENTION

It is therefore an objective of the present invention to provide a method of compensating pixel data and a related timing controller, which are capable of compensating errors of pixel data caused by crosstalk.

An embodiment of the present invention discloses a method of compensating pixel data for a display panel, which comprises the steps of: receiving a first pixel data and a second pixel data respectively corresponding to two adjacent data lines of the display panel; generating a compensation pixel data by searching a lookup table based on the first pixel data and the second pixel data; and transmitting the compensation pixel data to one of the two adjacent data lines to be displayed on the display panel.

Another embodiment of the present invention discloses a timing controller, which comprises a memory and a compensation circuit. The memory is configured to store a lookup table. The compensation circuit, coupled to the memory, is configured to perform the following steps: receiving a first pixel data and a second pixel data respectively corresponding to two adjacent data lines of a display panel; generating a compensation pixel data by searching the lookup table based on the first pixel data and the second pixel data; and transmitting the compensation pixel data to one of the two adjacent data lines to be displayed on the display panel.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
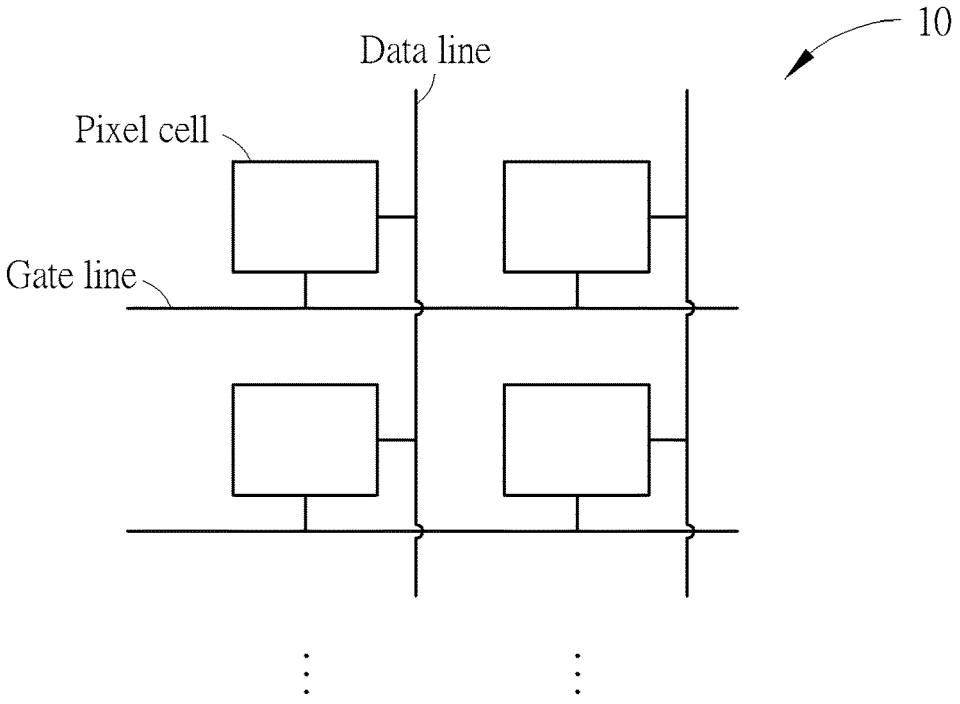
FIG. 1 PRIOR ART
FIG. 1 is a schematic diagram of a display panel.
Figure 2:
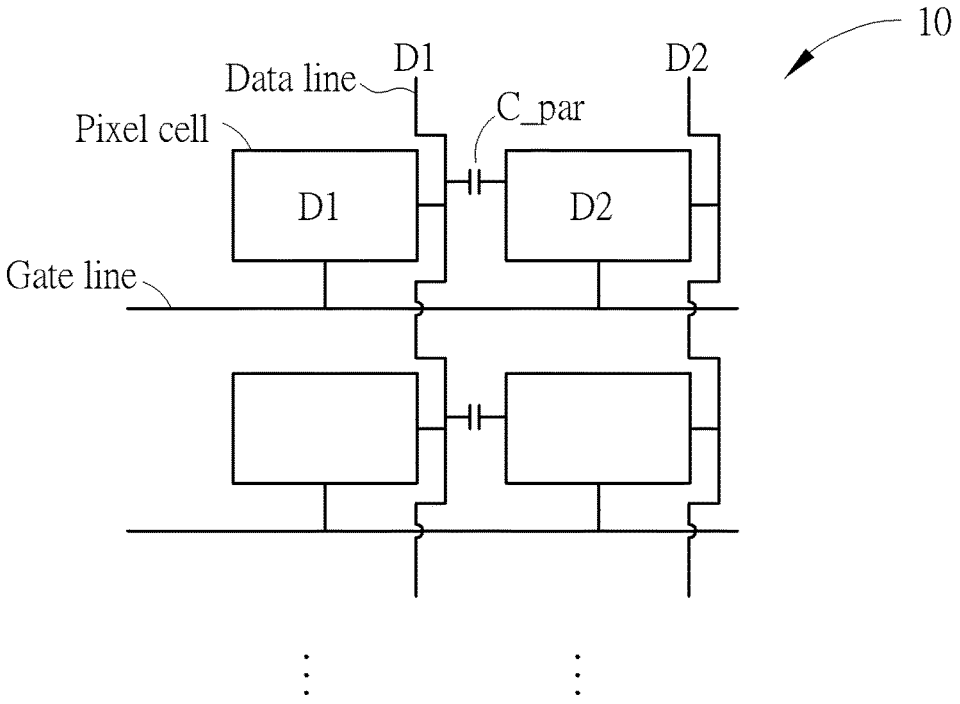
FIG. 2 PRIOR ART
FIG. 2 is a schematic diagram of deployment of data lines in the display panel.
Figure 3:
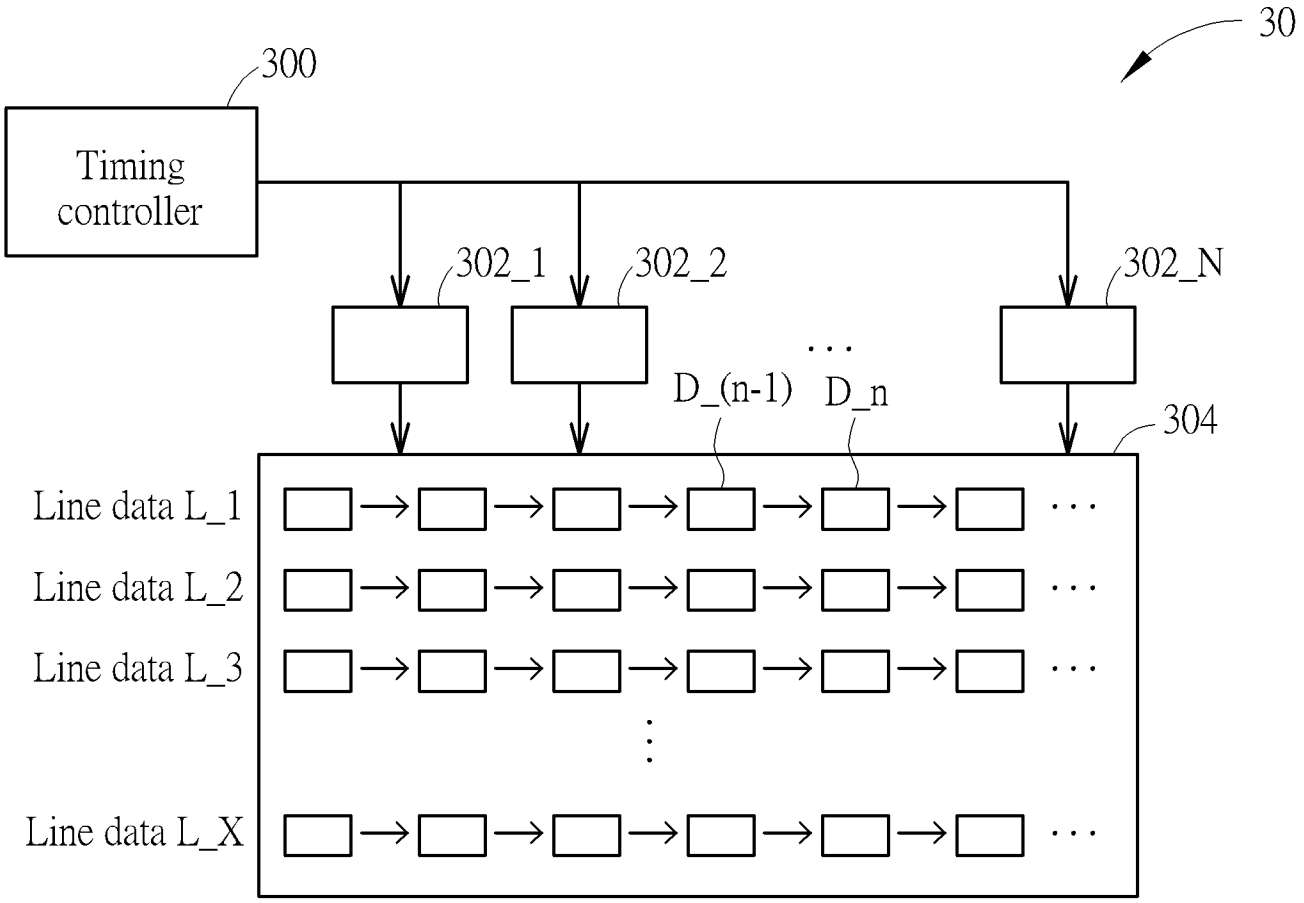
FIG. 3 is a schematic diagram of a display system.

Please refer to FIG. 3, which is a schematic diagram of a display system 30. The display system 30 includes a timing controller 300, at least one source driver (in this embodiment there are a plurality of source drivers 302_1-302_N) and a display panel 304. The source drivers 302_1-302_N may be disposed in a driver IC, or may be integrated with the display panel 304 as being disposed on the glass substrate of the display panel 304. In an embodiment, each of the timing controller 300 and the source drivers 302_1-302_N may be disposed in a respective chip. Alternatively, the timing controller 300 and the source drivers 302_1-302_N may be integrated in a single chip. In general, the timing controller 300 transmits image data to the source drivers 302_1-302_N via a serial interface; that is, each pixel data is transmitted to the source drivers 302_1-302_N in series, and may be received by its target source driver. Subsequently, the image data are latched in the source drivers 302_1-302_N and then forwarded to the display panel 304 line by line, as the line data L_1-L_X. In detail, each of the line data L_1, L_2 . . . , and L_X is transmitted to the display panel 304 via respective data lines during the same scan cycle, with the control of corresponding gate lines. Display of an entire image frame is completed after the X line data are transmitted to the display panel 304 in X scan cycles.

As shown in FIG. 3, each block in the display panel 304 refers to a subpixel cell, each filled with a pixel data of the image frame, and the arrows in the display panel 304 refer to the order of the timing controller 300 transmitting the pixel data via the serial interface. As mentioned above, since horizontal crosstalk may occur between two adjacent columns of subpixels (with the parasitic capacitance between the data line and the subpixel cell in two adjacent columns of subpixels), every two consecutive pixel data in the same line data L_1-L_X (i.e., forwarded to two adjacent columns of subpixels) may interfere with each other.

Figure 4:
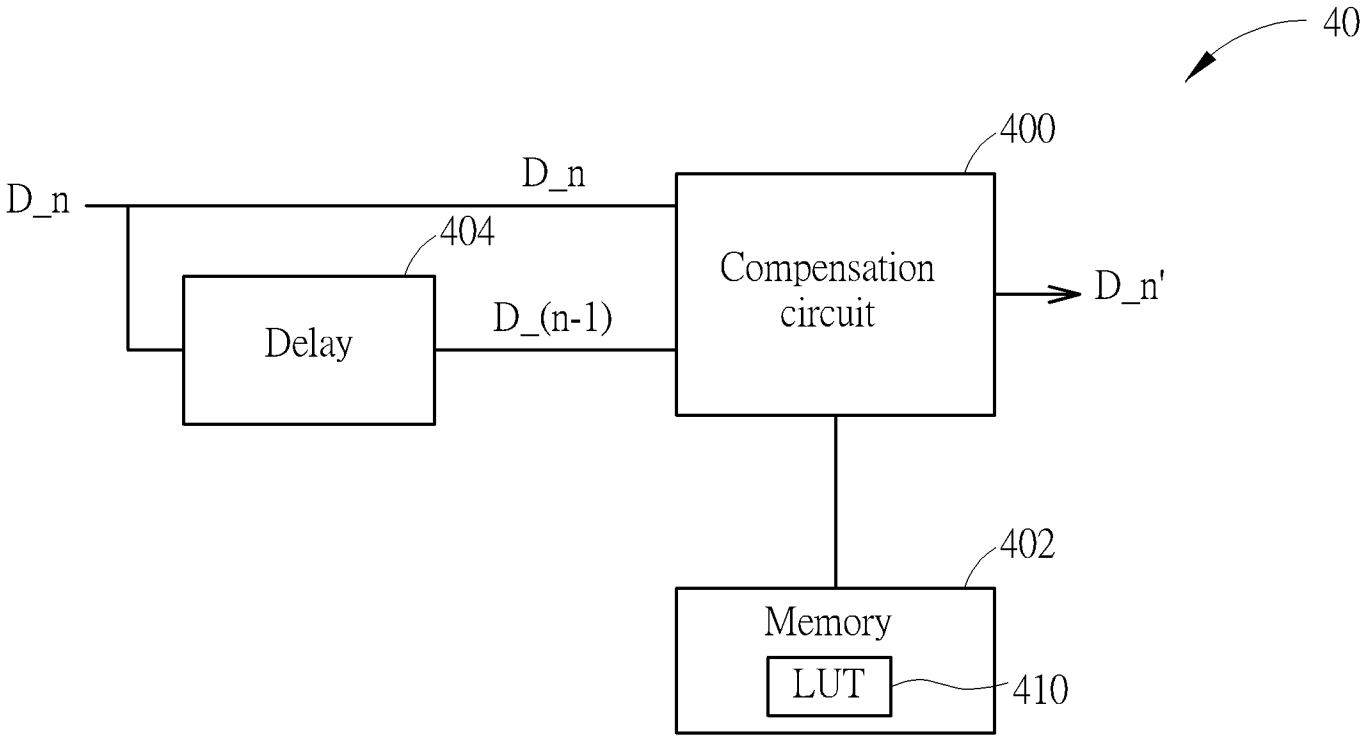
FIG. 4 is a schematic diagram of a timing controller according to an embodiment of the present invention.

The embodiments of the present invention provide a compensation scheme for canceling the interference of the pixel data due to crosstalk in the display panel. Please refer to FIG. 4, which is a schematic diagram of a timing controller 40 according to an embodiment of the present invention. The timing controller 40 includes a compensation circuit 400, a memory 402 and a delay module 404. The memory 402 is configured to store a lookup table (LUT) 410, which records the compensation information for canceling the interference of pixel data generated from the crosstalk between adjacent subpixel cells. The memory 402 may be implemented with any type of memory device such as a random access memory (RAM), read-only memory (ROM), flash memory, optical storage device, or combination of different types of memory devices. The compensation circuit 400 is configured to receive a plurality of pixel data and thereby generate compensation pixel data by searching the LUT 410 based on the received pixel data. The timing controller 40 thereby transmits the compensation pixel data to the display panel. Other possible modules or components of the timing controller 40 such as a modulator/demodulator, frame rate converter and data transmitter may be included or not according to system requirements. These modules are omitted herein without affecting the illustrations of the present embodiment. The timing controller 40 may be implemented as the timing controller 300 shown in FIG. 3, to realize the compensation scheme for crosstalk in the display panel 304.

In detail, the compensation circuit 400 may receive a pixel data D_n and its previous pixel data D_(n−1), and generate a compensation pixel data D_n' based on the two consecutive pixel data D_n and D_(n−1). The delay module 404 provides a delay on the received pixel data, allowing the pixel data D_n and D_(n−1) to be received and processed by the compensation circuit 400. The delay module 404 may be implemented with a delay circuit capable of delaying a received pixel data by a clock cycle. Subsequently, the compensation circuit 400 searches the LUT 410, which records possible compensation pixel data with reference to combinations of a current pixel data and a previous pixel data. Therefore, the compensation pixel data D_n' may be obtained by referring to the values of the pixel data D_n and D_(n−1). The compensation circuit 400 then transmits the compensation pixel data D_n' to the source driver, allowing the compensation pixel data D_n' to be displayed on the display panel, wherein the compensation pixel data D_n' is transmitted to a data line instead of the pixel data D_n. The difference between the compensation pixel data D_n' and the original pixel data D_n will compensate the influence from the pixel data D_(n−1) on the pixel data D_n due to crosstalk in the display panel.

With the display mechanism, the two consecutive pixel data D_n and D_(n−1) may belong to the same line data to be forwarded to two adjacent columns of subpixel cells in the same row, as shown in FIG. 3. There is crosstalk between the data line and the subpixel cell in two adjacent columns, and the crosstalk affects the brightness shown in each subpixel cell. For example, the pixel data D_n and D_(n−1) may respectively correspond to a first data line and a second data line adjacent to the first data line. More specifically, the pixel data D_n and D_(n−1) are configured to be displayed in two adjacent subpixel cells corresponding to the first data line and the second data line, respectively, during the same scan cycle. If the compensation scheme is applied, the compensation pixel data D_n' may be transmitted to the first data line instead of the pixel data D_n. In another embodiment, the compensation circuit 400 is configured to generate a compensation pixel data D_(n−1)' based on the pixel data D_(n−1) and its next pixel data D_n, where the compensation pixel data D_(n−1)' is transmitted to the second data line instead of the pixel data D_(n−1). Note that the compensation scheme may be performed for each pixel data based on the previous pixel data and/or the next pixel data, according to the deployment of data lines and subpixels on the display panel and the crosstalk generated with the deployment. More specifically, the crosstalk of a subpixel cell may be generated from an adjacent data line in the left-side column or the right-side column based on the deployment on the display panel.

It should also be noted that the compensation scheme of the present invention is different from the conventional overdrive scheme for display data. In the conventional overdrive scheme, if the difference between the current pixel data and the previous pixel data transmitted via the same data line is large such that the data line does not have enough time to be charged to a target level of the current pixel data from a level of the previous pixel data, the current pixel data may be modified to a further level to overdrive the data line; hence, the current pixel data and the previous pixel data transmitted by the same data line in two consecutive scan cycles. In comparison, in the compensation scheme of the present invention, the pixel data is modified to cancel the crosstalk between the subpixel cell and the data line in adjacent columns, where the subpixel cell and the adjacent data line receive different pixel data in the same scan cycle, such that the pixel value in the subpixel cell is erroneously pulled to a higher or lower level due to interferences of the pixel data in the adjacent data line. Therefore, the compensation circuit of the present invention may obtain the compensation pixel data by adjusting the received current pixel data based on the value of the previous pixel data and/or the next pixel data, where the adjustment degree is configured to cancel the error of pixel data generated from crosstalk.

In order to precisely cancel the interferences generated from crosstalk, the values in the LUT 410 may be well predetermined. Suppose that the compensation pixel data D_n' is configured to replace the pixel data D_n to be transmitted to the display panel. When the pixel data D_(n−1) is greater than the pixel data D_n, the compensation pixel data D_n' may be smaller than the pixel data D_n. More specifically, since the greater pixel data D_(n−1) in the adjacent data line may pull the pixel value in the subpixel cell corresponding to the pixel data D_n to a higher level due to crosstalk interferences, the compensation pixel data D_n' actually received by the subpixel cell should be smaller so as to cancel the pull-high influences of the crosstalk. When the pixel data D_(n−1) is smaller than the pixel data D_n, the compensation pixel data D_n' may be greater than the pixel data D_n. More specifically, since the smaller pixel data D_(n−1) in the adjacent data line may pull the pixel value in the subpixel cell corresponding to the pixel data D_n to a lower level due to crosstalk interferences, the compensation pixel data D_n' actually received by the subpixel cell should be larger so as to cancel the pull-low interferences of the crosstalk. An exemplary LUT 410 is as Table 1 shown below:

| | | Previous pixel data D_(n−1)(or next pixel data) | | | | | | | | |
|---|---|---|---|---|---|---|---|---|---|---|
| D_n' | | 0 | 32 | 64 | 96 | 128 | 160 | 192 | 224 | 255 |
| Current | 0 | 0 | 0 | 0 | 0 | 0 | 0 | 0 | 0 | 0 |
| pixel | 32 | 35 | 32 | 31 | 31 | 30 | 29 | 29 | 28 | 26 |
| data | 64 | 70 | 65 | 64 | 63 | 62 | 61 | 60 | 58 | 53 |
| D_n | 96 | 104 | 99 | 98 | 96 | 95 | 93 | 92 | 90 | 84 |
| | 128 | 137 | 132 | 131 | 129 | 128 | 127 | 125 | 123 | 117 |
| | 160 | 169 | 165 | 164 | 163 | 161 | 160 | 158 | 156 | 151 |
| | 192 | 201 | 198 | 196 | 196 | 195 | 193 | 192 | 190 | 186 |
| | 224 | 230 | 228 | 228 | 227 | 227 | 226 | 225 | 224 | 221 |
| | 255 | 255 | 255 | 255 | 255 | 255 | 255 | 255 | 255 | 255 |

As shown in Table 1, the obtained compensation pixel data D_n' is larger than the current pixel data D_n if the previous pixel data D_(n−1) (or the next pixel data) is smaller, and the obtained compensation pixel data D_n' is smaller than the current pixel data D_n if the previous pixel data D_(n−1) (or the next pixel data) is larger, except for the situation that the current pixel data D_n is 0 or 255. In this embodiment, the minimum value of pixel data is 0, and thus the obtained compensation pixel data D_n' may be the minimum value 0 if it tends to be lower than 0 to cancel the crosstalk interferences. The maximum value of pixel data is 255, and thus the obtained compensation pixel data D_n' may be the maximum value 255 if it tends to be higher than 255 to cancel the crosstalk interferences. Note that the values shown in Table 1 are an exemplary embodiment of the LUT 410. Those skilled in the art should realize that the LUT 410 may be configured to indicate the compensation pixel data D_n' corresponding to every possible combination of values of the current pixel data D_n (from 0 to 255) and the previous pixel data D_(n−1) (from 0 to 255).

The values of the LUT 410 may be obtained by measuring the brightness of the subpixel cell with a predefined image pattern to calculate the required compensation degree. In an embodiment, every subpixel cell in the display panel may receive the same target pixel data at the same time, and the brightness in the subpixel cell is measured. Since all subpixel cells receive the same pixel data, no crosstalk may be generated; hence, the measured brightness will be correct. This correct brightness is then applied as the basis for adjusting the brightness corresponding to the target pixel data under the interferences of crosstalk. For example, the pixel data 160 may be transmitted to all subpixel cells in the display panel at the same time, to measure and obtain the brightness. Subsequently, the subpixel cells may receive an image pattern in which a reference pixel data is forwarded to odd columns of subpixels and the target pixel data is forwarded to even columns of subpixels. Therefore, crosstalk may occur between the subpixel cells and the data lines of every two adjacent columns. In such a situation, the brightness of the even columns of subpixels (which corresponding to the target pixel data) may be affected due to interferences caused by the reference pixel data with the parasitic capacitance between two adjacent columns. For example, the target pixel data 160 may be forwarded to even columns of subpixels while the reference pixel data 32 may be forwarded to odd columns of subpixels, which generates crosstalk and reduces the brightness of the even columns of subpixels receiving the pixel data 160. Subsequently, the pixel data transmitted to the even columns of subpixels may be increased, and meanwhile the brightness of the even columns of subpixels under the crosstalk with the reference pixel data transmitted to odd columns of subpixels is measured. When the measured brightness reaches the correct brightness previously obtained in the situation where all subpixel cells receive the target pixel data, the corresponding pixel data transmitted to the even columns of subpixels may be an appropriate compensation pixel data. In this embodiment, the target pixel data is 160 and the reference pixel data is 32, and the obtained pixel data after adjustment will be 165. Therefore, the value of pixel data D_n' is 165 corresponding to the current pixel data D_n 160 and the previous pixel data D_(n−1) 32, as shown in Table 1.

Please note that the present invention aims at providing a method of compensating pixel data for canceling the interferences of crosstalk between the data lines and the subpixel cells in two adjacent columns of subpixels. Those skilled in the art may make modifications and alternations accordingly. For example, the above values of the target pixel data and the reference pixel data recited herein are merely served as examples for illustrating the method of generating the LUT. This method may be performed repeatedly for obtaining all values recorded in the LUT. In addition, in the above embodiment, the compensation pixel data is obtained by adjusting the current pixel data based on the previous pixel data. In another embodiment, it is also feasible to adjust the current pixel data based on the next pixel data to obtain the compensation pixel data. The implementation method may be determined based on the deployment on the display panel where the brightness of pixel value is easily affected by the data line of the left-hand adjacent column and/or the right-hand adjacent column.

Figure 5:
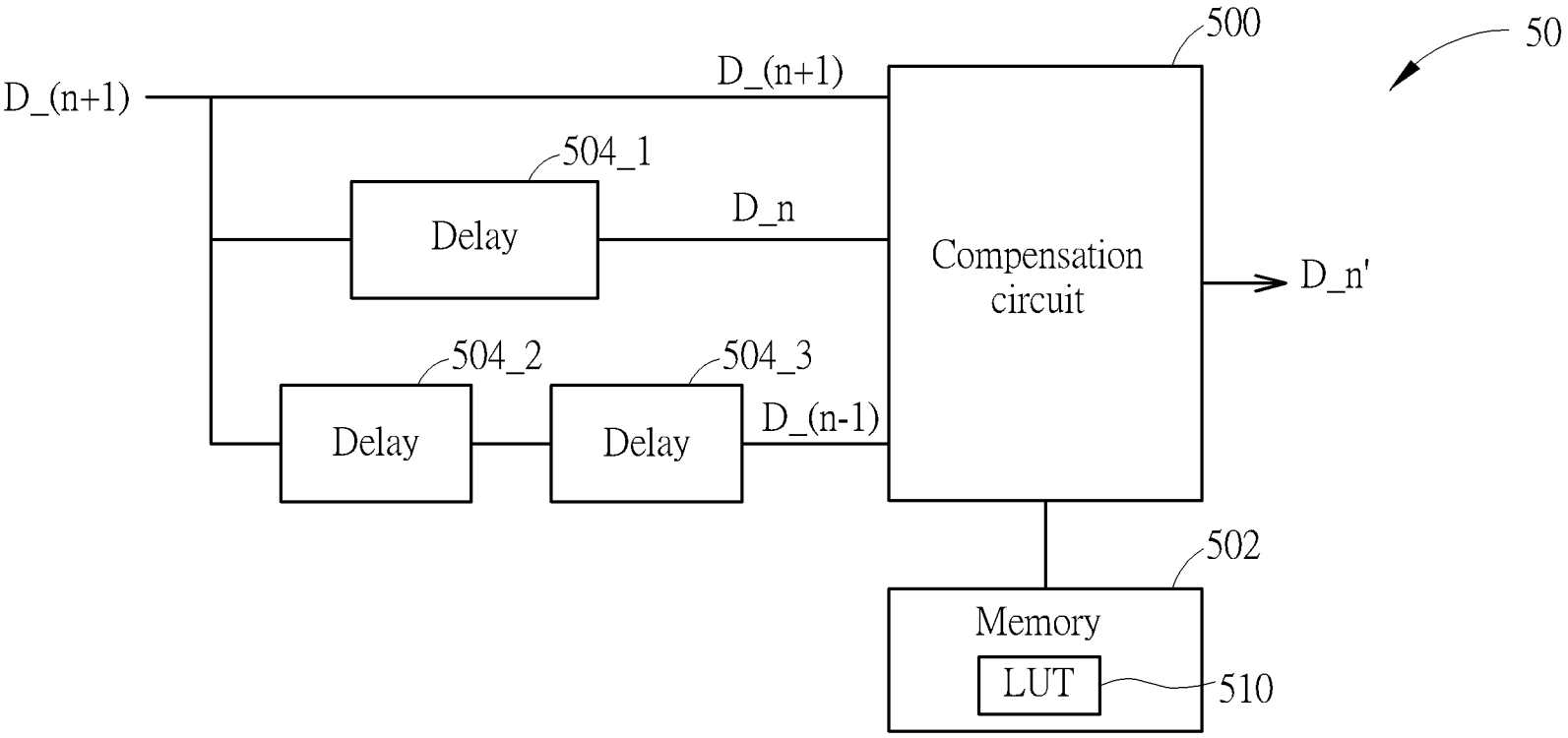
FIG. 5 is a schematic diagram of another timing controller according to an embodiment of the present invention.
Figure 6:
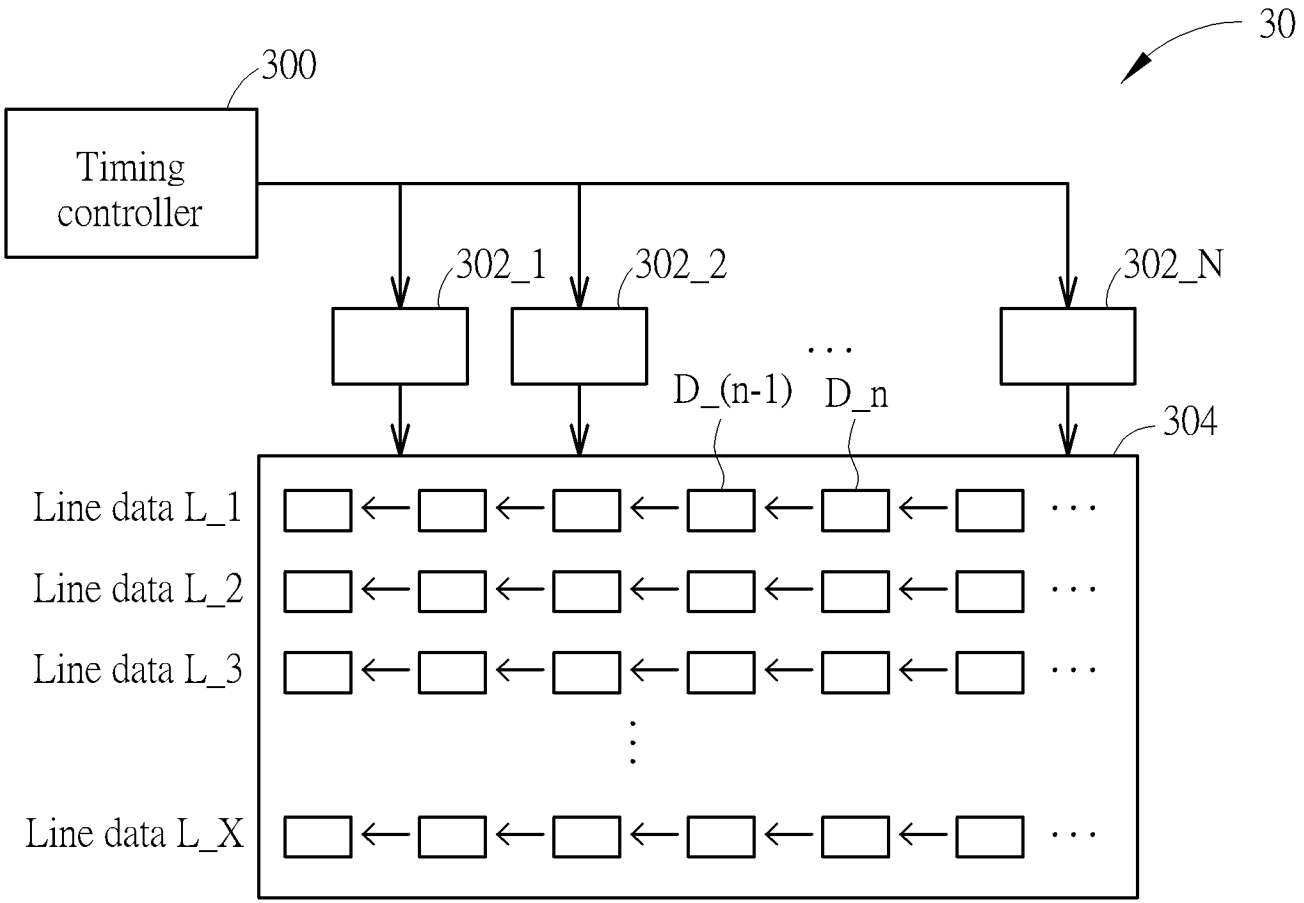
FIGS. 6 and 7 are schematic diagrams of the display system with different orders of pixel data transmission.

Please refer to FIG. 5, which is a schematic diagram of another timing controller 50 according to an embodiment of the present invention. The timing controller 50 includes a compensation circuit 500, a memory 502 and delay modules 504_1-504_3, and the memory 502 is configured to store an LUT 510. The LUT 510 records compensation information with reference to the current pixel data D_n, the previous pixel data D_(n−1) and the next pixel data D_(n+1). Therefore, the compensation circuit 500 may obtain the compensation pixel data D_n' by adjusting the pixel data D_n based on the value(s) of the previous pixel data D_(n−1), the next pixel data D_(n+1), or both. The detailed operations of the compensation circuit 500 and the delay modules 504_1-504_3 are similar to those of the compensation circuit 400 and the delay module 404, and will not be narrated herein.

Please note that the timing controller and the compensation circuit of the present invention are applicable to any display panel such as the display panel 304 as shown in FIG. 3, but this is not limited thereto. In FIG. 3, the timing controller 300 outputs the pixel data to the source drivers 302_1-302_N via the serial interface with an order corresponding to subpixel cells from left to right and top to bottom in the display panel 304. In another embodiment, the order of transmitting the pixel data may be realized by another method, such as from right to left as shown in FIG.

Figure 7:
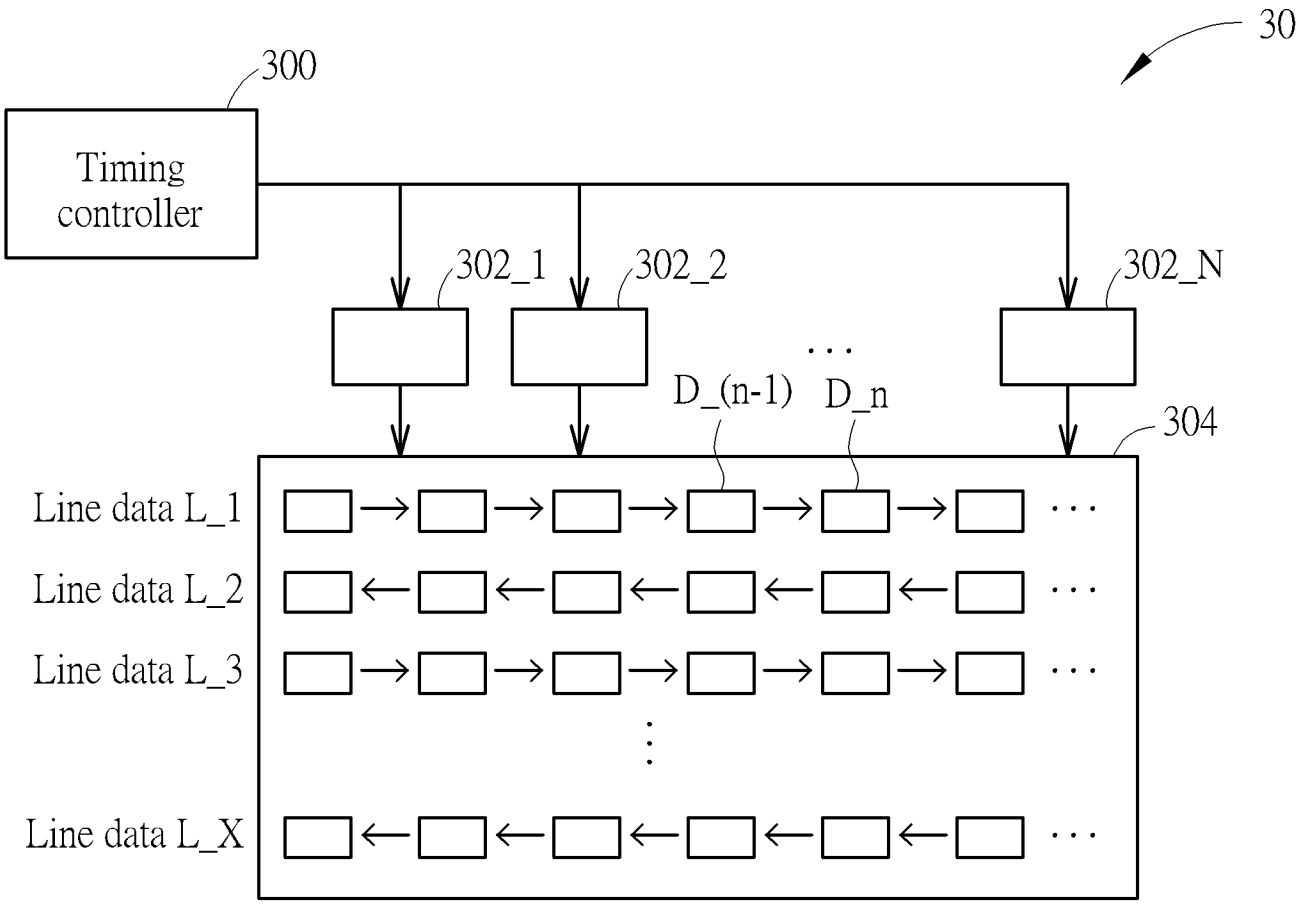

6, or in an S-shape order as shown in FIG. 7. The compensation scheme may be applied with reference to the previous pixel data D_(n−1) and/or the next pixel data D_(n+1) accordingly.

Figure 8:
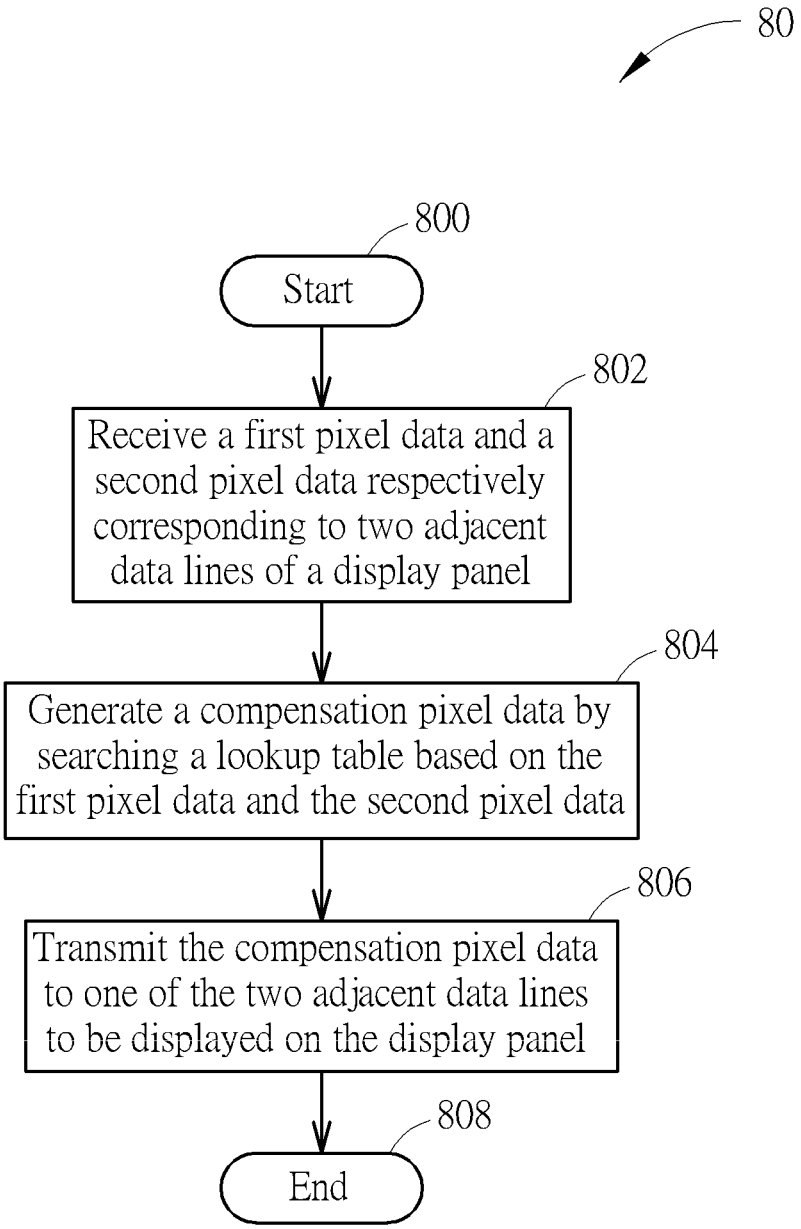
FIG. 8 is a schematic diagram of a compensation process according to an embodiment of the present invention.

The above operations of compensating pixel data performed in the compensation circuit of the timing controller may be summarized into a compensation process 80, as shown in FIG. 8. The compensation process 80, which may be used in the compensation circuit 400 shown in FIG. 4 and/or the compensation circuit 500 shown in FIG. 5, includes the following steps:

Step 800: Start.

Step 802: Receive a first pixel data and a second pixel data respectively corresponding to two adjacent data lines of a display panel.

Step 804: Generate a compensation pixel data by searching a lookup table based on the first pixel data and the second pixel data.

Step 806: Transmit the compensation pixel data to one of the two adjacent data lines to be displayed on the display panel.

Step 808: End.

The detailed operations and alternations of the compensation process 80 are illustrated in the above paragraphs, and will be omitted herein.

To sum up, the embodiments of the present invention provide a method of compensating pixel data for canceling the influences on the pixel data due to crosstalk between the data lines and subpixel cells in adjacent columns (i.e., interferences caused by parasitic capacitance between two adjacent columns with different pixel values). The compensation circuit of the timing controller may generate a compensation pixel data by adjusting the current pixel data based on the previous pixel data and/or the next pixel data, and thereby transmit the compensation pixel data to its target data line and subpixel cell in the display panel instead of the current pixel data. With the compensation scheme, the pixel data is adjusted or modified to cancel the crosstalk between the subpixel cell and the adjacent data line.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method of compensating pixel data for a display panel, comprising:

receiving a first pixel data and a second pixel data respectively configured to be transmitted to a first data line and a second data line of the display panel, wherein the second data line is adjacent to the first data line;

generating a compensation pixel data with reference to both the first pixel data and the second pixel data by searching a lookup table based on the first pixel data and the second pixel data; and transmitting the compensation pixel data, instead of the first pixel data, to the first data line to be displayed on the display panel.

2. The method of claim 1, wherein the first pixel data and the second pixel data are configured to be displayed in two adjacent subpixel cells respectively corresponding to the first data line and the second data line during a same scan cycle.

3. The method of claim 1, wherein the second pixel data is next to the first pixel data or previous to the first pixel data.

4. The method of claim 1, wherein the compensation pixel data is obtained by adjusting the first pixel data based on a value of the second pixel data.

5. The method of claim 1, wherein the compensation pixel data is smaller than the first pixel data when the second pixel data is greater than the first pixel data, and the compensation pixel data is greater than the first pixel data when the second pixel data is smaller than the first pixel data.

6. The method of claim 1, wherein the second pixel data is next to the first pixel data, and the method further comprising:

receiving a third pixel data previous to the first pixel data, wherein the third pixel data, the first pixel data and the second pixel data respectively correspond to three adjacent data lines of the display panel.

7. The method of claim 6, wherein the compensation pixel data is generated by searching the lookup table based on the first pixel data, the second pixel data and the third pixel data.

8. A timing controller, comprising:

a memory, configured to store a lookup table; and a compensation circuit, coupled to the memory, configured to perform the following steps:

receiving a first pixel data and a second pixel data respectively configured to be transmitted to a first data line and a second data line of a display panel, wherein the second data line is adjacent to the first data line;

generating a compensation pixel data with reference to both the first pixel data and the second pixel data by searching the lookup table based on the first pixel data and the second pixel data; and transmitting the compensation pixel data, instead of the first pixel data, to the first data line to be displayed on the display panel.

9. The timing controller of claim 8, wherein the first pixel data and the second pixel data are configured to be displayed in two adjacent subpixel cells respectively corresponding to the first data line and the second data line during a same scan cycle.

10. The timing controller of claim 8, wherein the second pixel data is next to the first pixel data or previous to the first pixel data.

11. The timing controller of claim 8, wherein the compensation pixel data is obtained by adjusting the first pixel data based on a value of the second pixel data.

12. The timing controller of claim 8, wherein the compensation pixel data is smaller than the first pixel data when the second pixel data is greater than the first pixel data, and the compensation pixel data is greater than the first pixel data when the second pixel data is smaller than the first pixel data.

13. The timing controller of claim 8, wherein the second pixel data is next to the first pixel data, and the timing controller is further configured to perform the following step:

receiving a third pixel data previous to the first pixel data, wherein the third pixel data, the first pixel data and the second pixel data respectively correspond to three adjacent data lines of the display panel.

14. The timing controller of claim 13, wherein the compensation pixel data is generated by searching the lookup table based on the first pixel data, the second pixel data and the third pixel data.

* * * * *